US007168108B2

(12) United States Patent
Guerin et al.

(10) Patent No.: US 7,168,108 B2
(45) Date of Patent: Jan. 30, 2007

(54) SHOWER SYSTEM

(75) Inventors: Jeanne Guerin, Mukilteo, WA (US); Douglas E. Emsley, Bothell, WA (US); Donald R. Furlong, Woodinville, WA (US); Dennis C. Lin, Everett, WA (US)

(73) Assignee: The Boeing Company, Chicago, IL (US)

( * ) Notice: Subject to any disclaimer, the term of this patent is extended or adjusted under 35 U.S.C. 154(b) by 221 days.

(21) Appl. No.: 10/708,749

(22) Filed: Mar. 23, 2004

(65) Prior Publication Data

US 2005/0210576 A1 Sep. 29, 2005

Related U.S. Application Data

(63) Continuation-in-part of application No. 10/104,331, filed on Mar. 22, 2002, which is a continuation-in-part of application No. 10/078,859, filed on Feb. 20, 2002, now Pat. No. 6,604,709.

(51) Int. Cl.
*A47K 3/022* (2006.01)

(52) U.S. Cl. ..... 4/596; 4/597; 4/525

(58) Field of Classification Search ..... 4/597, 4/525, 524, 612, 614, 613, 598, 569, 596, 4/615, 601; 52/264; 34/202, 224, 225, 232, 34/233; 607/87

See application file for complete search history.

(56) References Cited

U.S. PATENT DOCUMENTS 2,650,368 A 9/1953 Evans
3,007,178 A * 11/1961 Altman et al. ..... 4/525
3,128,161 A * 4/1964 Hudon et al. ..... 34/233
3,396,411 A 8/1968 Vieceli
3,587,118 A 6/1971 Compton
3,958,756 A 5/1976 Trenary et al.
4,130,120 A 12/1978 Kohler, Jr.
4,340,981 A 7/1982 Vanags
4,348,777 A 9/1982 Peterson
4,424,598 A 1/1984 Cima
4,425,672 A 1/1984 Johnson et al.

(Continued)

FOREIGN PATENT DOCUMENTS

DE 298 20 581 11/1999

(Continued)

OTHER PUBLICATIONS

Lavatory Accessibility in single-aisle aircraft:, US Dept. of Transportation, 1-12, Appendix A.

(Continued)

*Primary Examiner*—Khoa D. Huynh
(74) *Attorney, Agent, or Firm*—Ostrager Chong Flaherty & Broitman P.C.

(57) ABSTRACT

A shower system includes a shower area defined by a shower stall or primary wall having at least one misting nozzle coupled thereto. The primary wall is enclosed by a shower stall housing or a secondary wall, whereby an air channel is defined between the shower stall and the shower stall housing. A controller directs misted air through the misting nozzle and further activates an air flow system such that misted air within the shower area flows through and is dried in the air channel.

41 Claims, 2 Drawing Sheets

U.S. PATENT DOCUMENTS

| | | | | |
|---|---|---|---|---|
| 4,477,934 | A | 10/1984 | Salminen | |
| 4,589,463 | A | 5/1986 | Ryan | |
| 4,645,145 | A | 2/1987 | Alie | |
| 4,724,553 | A * | 2/1988 | Bianchi | 4/615 |
| 4,884,767 | A | 12/1989 | Shibata | |
| 5,099,587 | A * | 3/1992 | Jarosch | 34/202 |
| 5,111,626 | A | 5/1992 | Fortune | |
| 5,150,863 | A | 9/1992 | Hozumi | |
| 5,243,716 | A | 9/1993 | Zaccai et al. | |
| 5,293,653 | A * | 3/1994 | Filipponi | 4/524 |
| 5,426,900 | A | 6/1995 | Springer | |
| 5,474,260 | A | 12/1995 | Schwertfeger et al. | |
| 5,718,008 | A | 2/1998 | Pane | |
| 6,007,025 | A | 12/1999 | Coughren et al. | |
| 6,047,416 | A * | 4/2000 | Carrier | 4/596 |
| 6,079,669 | A | 6/2000 | Hanay et al. | |
| 6,101,766 | A | 8/2000 | Mogensen | |
| 6,182,926 | B1 | 2/2001 | Moore | |
| 6,243,993 | B1 | 6/2001 | Swensson | |
| 6,256,936 | B1 | 7/2001 | Swensson et al. | |
| 6,257,523 | B1 | 7/2001 | Olliges | |
| 6,443,164 | B1 * | 9/2002 | Parker et al. | 132/333 |
| 6,604,709 | B1 | 8/2003 | Wentland et al. | |
| 6,962,005 | B1 * | 11/2005 | Khosropour et al. | 34/218 |
| 7,013,504 | B2 * | 3/2006 | Brunelle et al. | 4/597 |
| 2005/0086735 | A1 * | 4/2005 | Lim | 4/596 |

FOREIGN PATENT DOCUMENTS

| | | |
|---|---|---|
| EP | 0 872 204 | 4/1997 |
| EP | 1 064 875 | 7/1999 |
| EP | 1 075 829 | 7/2001 |
| GB | 2266662 A * | 11/1993 |
| JP | 11-350759 | 12/1999 |

OTHER PUBLICATIONS

Jim Hightower, "Hightower: Showers on Planes", AlterNet.org, Aug. 22, 2002.

* cited by examiner

SHOWER SYSTEM

CROSS-REFERENCE TO RELATED APPLICATIONS

This is a continuation-in-part of U.S. patent application Ser. No. 10/104,331 filed on Mar. 22, 2002, which in turn is a continuation-in-part of U.S. patent application Ser. No. 10/078,859 filed on Feb. 20, 2002, which issued as U.S. Pat. No. 6,604,709 on Aug. 12, 2003.

BACKGROUND OF INVENTION

The present invention relates generally to showering systems, and more particularly to a showering system in an aircraft environment.

Current aircraft shower systems are generally costly, and many use excessive amounts of water, and this requires significant water supply storage, which adds to the overall weight of the aircraft. These drawbacks make aircraft shower systems impractical and generally unavailable for commercial use.

In addition to the excessive burden on the aircraft due to excess water weight, it has heretofore been difficult to absorb costs associated with substituting a shower system for a passenger seating space on general commercial air lines.

In view of these burdens, offering showers to passengers on commercial airlines has been difficult to implement, even where demand has been high.

The disadvantages associated with current aircraft shower systems have made it apparent that a new technique for showering or showering on-board an aircraft is needed. The new technique should minimize water weight for the aircraft and should also require a minimal amount of space onboard the aircraft.

SUMMARY OF INVENTION

In accordance with one embodiment of the present invention, an airplane shower system includes a shower stall and a shower stall housing wherein an air channel is defined therebetween. The shower stall includes at least one misting nozzle, though it may include a plurality of height dependent nozzles, coupled thereto. The shower room also includes a fan for circulating air through the air channel and inside the shower stall. The shower room still further includes a water drain allowing water to drain from within the shower stall or the shower stall housing. The shower system may be controlled by a controller operating in response to commands from a user input device such as display.

In accordance with another embodiment of the present invention, a method for operating a shower system having a shower area for showering of a user includes receiving a height signal based on a height of the user and activating a plurality of nozzles as a function of the height signal. The method further includes activating a misting cycle wherein a mist is directed out of the nozzles, activating a soaping cycle, activating a drying cycle, activating a cleaning cycle in response to the user leaving the shower area, and blowing air into the shower area, thereby forcing misted air out of the shower area and into an air channel defined by at least one condensing surface.

One advantage of the present invention is that, while offering a refreshing shower and a sauna-type experience, the system uses minimal amounts of water and provides adjustability for user height. Another advantage of the present invention is that the shower system is applicable to other modes of transportation including railroad, cars, buses, maritime vehicles, and other such vehicles wherein water usage and availability is limited.

Additional advantages and features of the present invention will become apparent from the description that follows and may be realized by the instrumentalities and combinations particularly pointed out in the appended claims, taken in conjunction with the accompanying drawings.

BRIEF DESCRIPTION OF DRAWINGS

For a complete understanding of the invention, there will now be described some embodiments thereof, given by way of example, reference being made to the accompanying drawings, in which.

DETAILED DESCRIPTION

Figure 1:
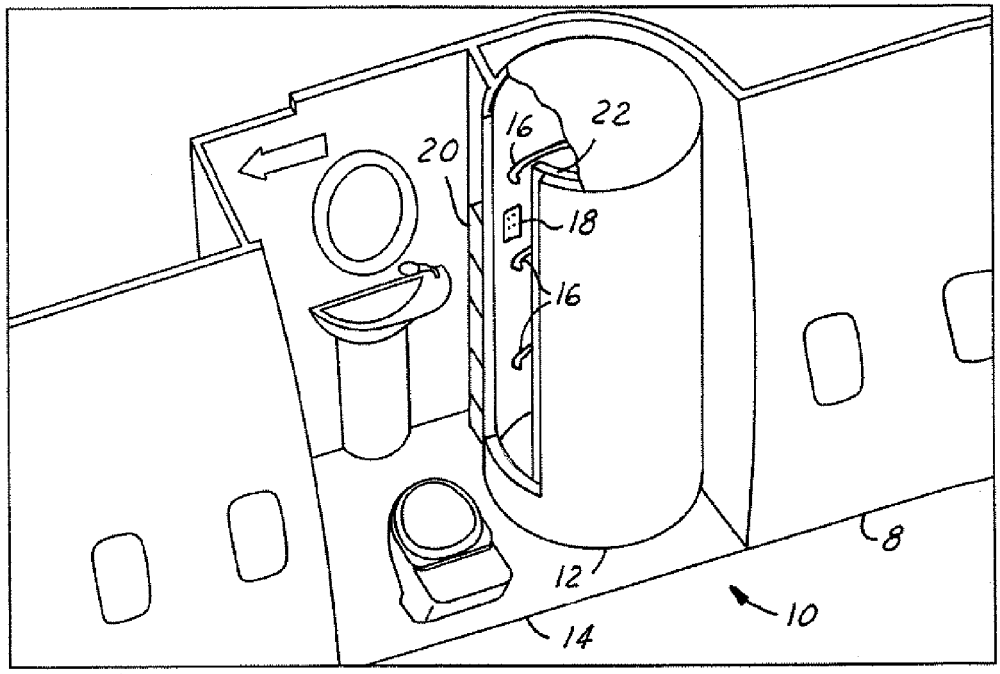
FIG. 1 is a perspective view of an airplane with a section broken away illustrating a shower system according to on embodiment of the present invention.

The present invention is illustrated with respect to a shower system, particularly suited to the aerospace field. The present invention is, however, applicable to various other uses that may require shower systems, such as campers, railroad cars, buses, maritime vehicles, and other such vehicles, as will be understood by one skilled in the art. In each of the following figures, the same reference numerals are used to refer to the same components.

Referring to FIG. 1, an airplane 8 including the shower system 10 is illustrated. A perspective view of the airplane 8 is shown having a piece of the airplane skin removed such that the shower system 10 is visible. The shower system 10, in the present embodiment of the invention, is illustrated with a shower room 12 and an adjacent changing area 14 or restroom. The shower system 10 is illustrated in accordance with one embodiment of the present invention. As was previously mentioned, the shower system 10 may be incorporated in various other vehicles, and the airplane embodiment is merely used for illustration.

The shower system 10 further includes a series of misting nozzles 16, a user controlled display 18, and a controller 20 for the system 10. Also, between the shower room 12 and the changing area 14, a door 22 is positioned such that a passenger may change in the changing area 14 and immediately enter the shower room 12 without requiring a separate changing room other than the included changing area 14.

Figure 2:
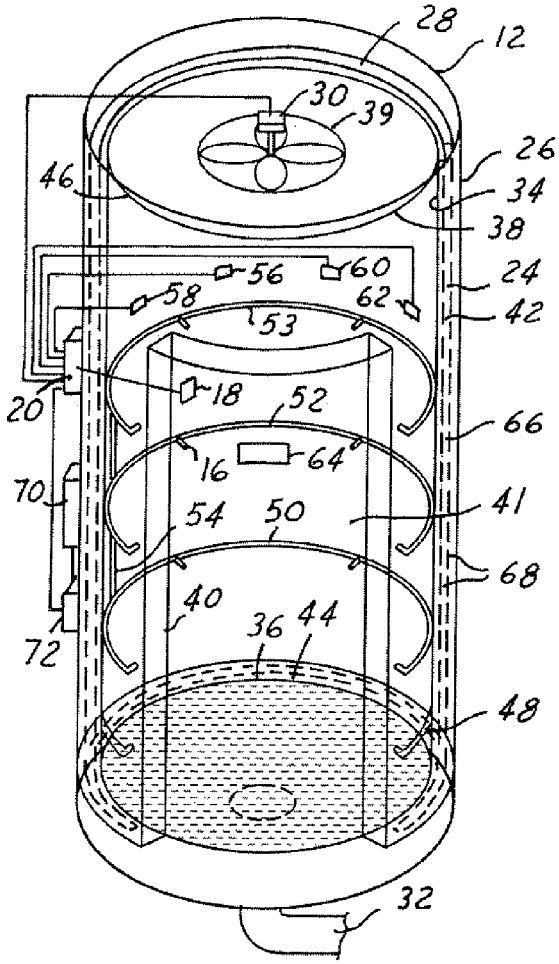
FIG. 2 is a perspective view of a shower system in accordance with another embodiment of the present invention.
Figure 3:
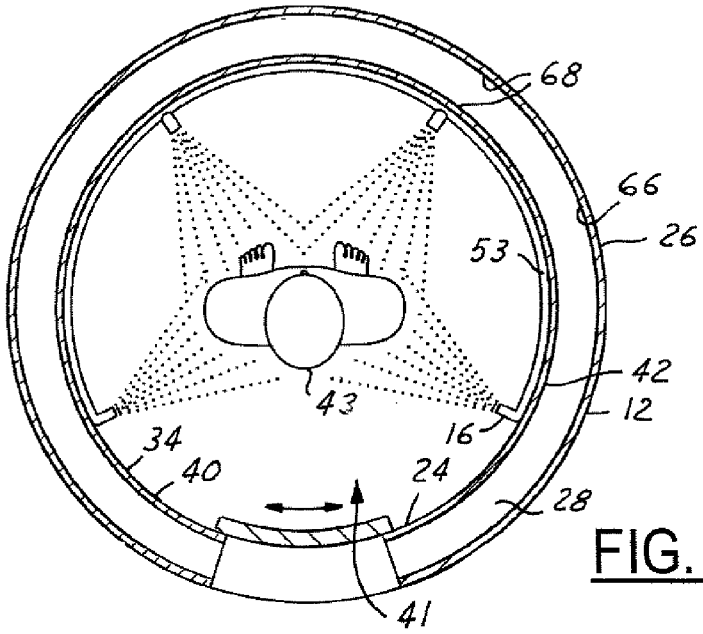
FIG. 3 is a top view of the shower system of FIG. 2.

Referring to FIGS. 2 and 3, the shower system 10 is illustrated in accordance with another embodiment of the present invention. The shower room 12 of the shower system 10 includes a shower stall or primary wall 24 and a shower stall housing or secondary wall 26 wherein an air channel 28 is defined therebetween. The primary wall 24 includes at least one misting nozzle 16, though preferably a plurality of nozzles 16 are coupled thereto. The shower room 12 also includes a fan 30 for circulating air through the air channel 28 and inside the primary wall 24. The shower room 12 still further includes a water drain 32 allowing water to drain from within the primary wall 24 or the secondary wall 26. The shower system 10 may be controlled by a controller 20 operating in response to commands from a user input device such as display 18.

The primary wall 24 of the shower room 12 substantially encloses the shower area 41. The illustrated primary wall 24 is cylindrical; however various other shapes of the internal primary wall 24 are also included in the present invention, such as cubicle, conical, spherical, irregular, or any other known three dimensional enclosure. The primary wall 24 includes a sidewall 34, a base 36, and a ceiling 38. The sidewall 34 includes an inner surface 40 facing the shower area 41 of the shower room 12, and an outer surface 42 facing the secondary wall 26.

The primary wall ceiling 38 is coupled to the top of the sidewall 34, and the primary wall base 36 is coupled to the bottom of the sidewall 34. Both the base 36 and the ceiling 38 have openings defined respectively therein.

The base 36 is embodied as perforated whereby warm moist air from within the shower area 41 may escape or be drawn out of the shower area 41. Alternate embodiments of the present invention include a single hole or plurality of holes defined within the base 36 such that the warm moist air may be removed from the shower area 41.

The ceiling 38, in accordance with one embodiment, includes at least one opening 39 defined therein such that air from the fan 30 may be blown into the shower area 41 both for the purposes of drying the passenger or user 43 and for blowing warm moist air out through the base 36. The fan 30 may also be positioned at any other section of the shower room 12, and the ceiling 38 need not include an opening therefor.

The walls of the shower area 41 including the inner sidewall surface 40, an inner surface of the base 44, and an inner surface of the ceiling 46 are embodied as either coated with or made up a hydrophobic surface, such that little or no water from the mist sprayed from the misting nozzles 16 condenses on their surfaces. Alternate embodiments of the present invention include only portions of the shower surfaces coated or made of a hydrophobic surface such that water condenses on some or all of the shower area surfaces and is therefrom drained from the system 10.

The shower area 41 is entered through the door 22, which is embodied as a swinging door or a sliding door on the inside or outside of the shower room 12. One embodiment of the system 10 activates in response to opening and closing of the door 22 such that the system 10 halts operations when the door 22 is opened.

The sidewall 34 is embodied as cylindrical such that substantially optimal misting may be arranged. Coupled to an inner surface 40 of the sidewall 34 is a plurality of misting nozzles 16, here embodied as four rows, first 48, second 50, third 52, and fourth 53 each having a number of misting nozzles 16, here embodied as four for the first three 48–52 and two for the fourth 53. The rows 48, 50, 52, 53 receive water from at least one water pipe 54.

Numerous other arrangements of misting nozzles 16 are also included in the present invention, such as having any number of misting nozzles 16 per nozzle row, or rather than having nozzle rows, including diagonal arrangements of nozzles or individual nozzles fed by a series of water pipes.

The row arrangement, in accordance with one embodiment of the present invention, includes a plurality of rows, here embodied as four such that the rows 48, 50, 52, 53 are activated or receive water as a function of the user's height. For example, a taller user would either activate or require activation of all four rows 48, 50, 52, 53 whereas a shorter user may require only use of the lower two rows 48, 50. The rows 48, 50, 52, 53 may be activated in response to a sensor arrangement evaluating a user's height, or in response to inputs from the user into the user display 18, which activates the controller 20.

The controller 20, in accordance with one embodiment of the present invention, receives signals from height sensors 56, such that the user's height may be determined, whereby the controller 20 activates nozzle rows dependant on that height. Alternate embodiments of the present invention include the user inputting the user height into the display 18 such that the controller 20 receives the input signal and activates rows as a function of that signal.

The controller 20 may control water pressure when temperature as a function of the distance of the nozzles 16 from the users for perfect water coverage and water temperature. Alternately, temperature sensors 58 and pressure sensors 60 are positioned around the inner surface 40 such that actual misting temperature and pressure at various points of the shower area 41 may be determined and adjusted through logic within the controller 20.

In accordance with another embodiment of the present invention, distance sensors 62 generating signals as a function of a distance of the user from the nozzles 16 are included in the system 10. Signals generated therefrom are received in the controller 20, which adjusts temperature and pressure accordingly to provide maximum user comfort.

The controller 20 may also include logic such that the water pipe 54 is drained between various user showers so that water temperature coming out of the nozzle 16 may be accurately controlled.

The controller 20 also may control mood lighting 64 and the LED display 18, such that as the various cycles of the shower operation are activated and completing various signals such as the changing of lighting texture or color, and/or signals on the LED display 18 are activated. Other signals may include informing the user how much time remains before the next cycle and what will occur during the next cycle.

One embodiment of the controller 20 controls cycles height adjustment, automatic system activation in response to closing the door 22, a time limited water cycle, a time-limited soap cycle (during which the water cycle may be halted or paused). The controller 20 may also control a rinse cycle, a drying cycle, and a cleaning cycle that activates in response to the closing of the door 20 and the exiting of the passenger.

Important to note is that the controller 20 may include default settings that are adjustable by the user, or it may be fully automated, such that no user input is required.

Another embodiment of the present invention includes the secondary wall 26 and the primary wall 24 defining an air panel therebetween. The interior surface 66 of the secondary wall 26 and the outer surface 42 of the primary wall 24 are embodied as including condensing surfaces 68 (first condensing surface and second condensing surface).

Generally, condensing surfaces 68 are cooler in temperature than the mist that is cycled past them, such that the mist condenses on the condensing surfaces 68. Examples of condensing surfaces 68 include stainless steel and various other metals and substances that are generally cooler than the mist from the nozzles 16.

Water is supplied to the system through a water tank 70, which receives a small amount of water as required for the entire misting cycle. Individual passengers may bring their own water and input it into the water tank 70, thereby ensuring that the water is fresh and clean. The water is later heated in a heater 72. Alternate embodiments of the present invention include water supplied from the main water storage area of the vehicle including the shower system 10.

Water from the nozzles 16 is generally drained to a water drain 32, whereby condensed water on the condensing surfaces 68 flows downward into the drain position near the bottom of the shower system 10 in response to gravity.

Figure 4:
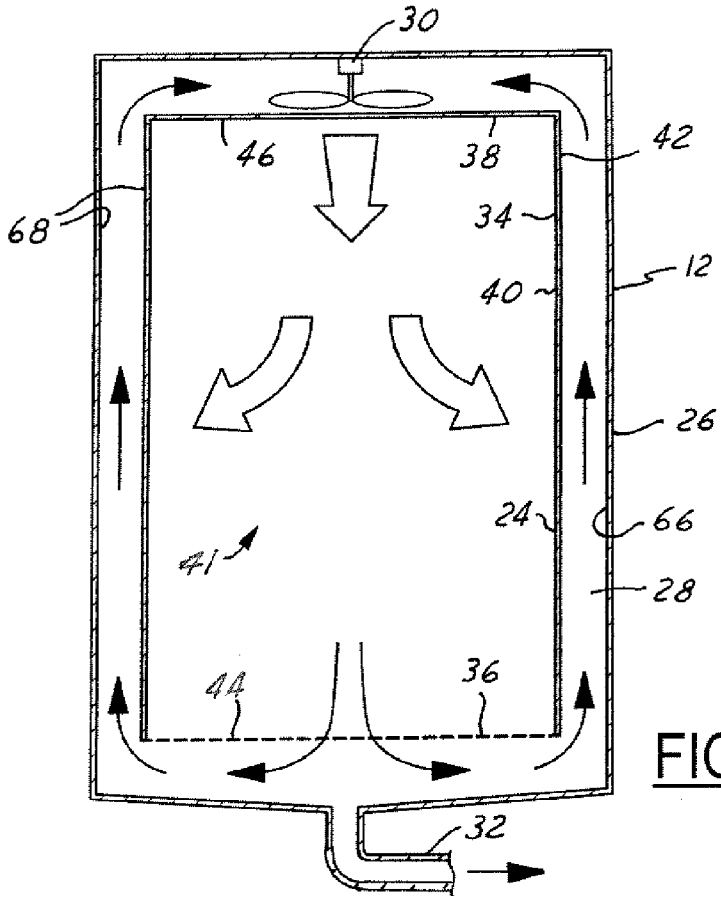
FIG. 4 is schematic diagram of air flow within a shower system in accordance with another embodiment of the present invention.

Referring to FIG. 4, the air flow dynamics of shower system 10, in accordance with another embodiment of the present invention is illustrated. As was previously discussed, air is blown into the shower area 41 both to dry the user and, during the cleaning cycle, to blow the misted air out of the shower area 41. The misted air is illustrated as blown out of the shower area 41 through openings in the base 36; however alternate embodiments of the present invention include the misted air blown out of openings defined in the walls 34 or ceiling 38, as will be understood by one skilled in the art.

The misted air may then be directed out of the system or through the air channel 28 such that water within the misted air condenses on condensing surfaces within the air channel 28. The dried air is then redirected into the shower area 41 until the fan 30 is halted by the user 43 or the controller 20.

In operation, a passenger enters the changing area 14 and generally prepares for the misting shower, by removing clothing and inputting water into the water tank 70. At this point, a heater 72 activates and warms the water in preparation for misting from the nozzle 16. The user may then input his height.

The user opens the door 22 and closes it, which may automatically activate misting from the nozzles 16. A misting cycle then begins wherein a specific signal, such as a light glows to indicate how much time remains before the next cycle. The next cycle, a soaping cycle, may include a pause in the misting to conserve water. The misting then reactivates, and a rinse cycle is engaged. A dry cycle is then activated, and the fan 30 blows air through the shower area, and the air is cycled whereby mist within the air is condensed on the condensing surfaces 68 and continually blown within the shower area 41.

Upon completion of the drying cycle, the user exits and closes the door behind them, and an automatic self-cleaning process activates, whereby remaining water in the water pipe 54 or within the nozzles 16 or nozzle rows 48, 50, 52 is drained and dried.

Important to note is that if during any of the cycles, the user wishes to exit, an automatic stop cycle may be included such that a timer 74 activates and allows the user a specific amount of time in which to resume the shower. If the user does not resume the shower within the timer-specified allocation, the cleaning process of the shower is activated.

From the foregoing, it can be seen that there has been brought to the art a new shower system 10. It is to be understood that the preceding description of one embodiment of the present invention is merely illustrative of some of the many specific embodiments that represent applications of the principals of the present invention. Numerous and other arrangements would be evident to those skilled in the art without departing from the scope of the invention as defined by the following claims.

The invention claimed is:

1. A shower system comprising:

a shower stall comprising a sidewall, a ceiling, and a base, said shower stall defining a shower area;

a shower stall housing enclosing said shower stall, wherein an air channel is defined between said shower stall and said shower stall housing;

at least one misting nozzle positioned within said shower stall;

at least one water pipe feeding said at least one misting nozzle;

at least one height sensor generating a height of user signal;

and a controller directing misted air through said at least one misting nozzle, said controller further activating an air flow system such that misted air within said shower area flows through and is dried in said air channel, wherein said controller receiving said height of user signal so that water is delivered to said at least one misting nozzle depending on the height of the user.

2. The system of claim 1, wherein said shower stall comprising a cylindrical, cubicle, conical, or irregular shape defining said shower area.

3. The system of claim 1 further comprising a user accessible water input tank receiving water from a user prior to said user taking a shower.

4. The system of claim 1 further comprising an input display, wherein commands are entered for at least one of user height or user desired temperature.

5. The system of claim 1, wherein said controller receives at least one of: a height of user signal, a temperature within said shower area signal, or a distance signal and adjusts said at least one misting nozzle as a function thereof.

6. The system of claim 5 further comprising at least one temperature sensor generating a temperature within said shower area signal.

7. The system of claim 5 further comprising at least one distance sensor generating a distance signal as a function of a distance between said at least one misting nozzle end the user.

8. The system of claim 1 further comprising a plurality of misting nozzles.

9. The system of claim 8 further comprising a first number of said plurality of misting nozzles on a first row receiving water from said pipe.

10. The system of claim 9 further comprising a second number of said plurality of misting nozzles mounted on a second row receiving water from said pipe.

11. The system of claim 10 further comprising a third number of said plurality of misting nozzles mounted on a third row receiving water from said pipe.

12. The system of claim 1, wherein said base defines at least one opening for receiving mist.

13. The system of claim 12, wherein said base is perforated.

14. The system of claim 1, wherein sides of said shower stall and said shower stall housing comprise at least one condensing surface.

15. The system of claim 14 further comprising a drain receiving water from said at least one condensing surface.

16. The system of claim 1, wherein said controller further comprises logic for activating a misting cycle wherein a mist is directed out of said at least one misting nozzle for a passenger selectable time period within a first predetermined time period, activating a soaping cycle for a passenger selectable time period within a second predetermined time period, activating a rinsing cycle for a passenger selectable time period within a third predetermined time period, activating a drying cycle for a passenger selectable time period within a fourth predetermined time period, and activating a cleaning cycle in response to the user leaving said shower area for a fifth predetermined time period.

17. The system of claim 16, wherein said first time period is less than 60 seconds, said second time period is less than 240 seconds, said third time period is less than 600 seconds, said fourth time period is less than 600 seconds, and said fifth time period is less than 90 seconds.

18. An airplane shower system comprising:

a changing area;

a shower stall adjacent to said changing area such that a user enters said shower stall directly from said changing area, said shower stall substantially cylindrical in shape and comprising, a primary wall comprising a sidewall comprising an interior surface and an exterior surface, a ceiling and a base, said interior surface of said primary wall defining a shower area, said interior surface comprising a hydrophobic surface, said exterior surface comprising a first condensing surface, a secondary wall comprising an inner surface, said inner surface of said secondary wall comprising a second condensing surface, wherein an air channel is defined between said exterior surface of said primary wall and said inner surface of said secondary wall such that water within mist flowing through said air channel condenses on said first condensing surface and said second condensing surface;

a first row of misting nozzles coupled to said primary wall such that said first row of misting nozzles direct mist into said shower area at multiple angles with respect to a central area of said shower area, wherein said central area is substantially trans-axial to said shower stall;

a second row of misting nozzles coupled to said primary wall below said first row of misting nozzles such that said second row of misting nozzles direct mist into said shower area;

a fan coupled to said shower stall;

at least one height sensor generating a height of user signal;

a controller activating said first row of misting nozzles and said second row of misting nozzles when a user is within a first height range and activating said second row of misting nozzles when said user is within a second height range, said controller further controlling said fan, thereby blowing misted air out of said shower area and through said base whereby said misted air flows through said air channel, wherein said controller receiving said height of user signal so that water is delivered to said rows of misting nozzles depending on the height of the user.

19. The system of claim 18, wherein said primary wall comprises a cylindrical, cubicle, conical, or irregular shape defining said shower area.

20. The system of claim 16 further comprising a user accessible water input tank receiving water from a user prior to said user taking a shower.

21. The system of claim 18 further comprising an input display wherein commands are entered for at least one of user height or user desired temperature.

22. The system of claim 18 further comprising at least one temperature sensor generating a temperature within said shower area signal.

23. The system of claim 18 further comprising at least one distance sensor generating a signal as a function of a distance between at least one of said plurality of misting nozzles and the user.

24. The system of claim 18 further comprising at least one water pipe feeding said plurality of misting nozzles.

25. The system of claim 16 further comprising a third number of said plurality of misting nozzles mounted on a third row receiving water from said pipe.

26. The system of claim 18, wherein said base defines at least one opening for receiving mist.

27. The system of claim 18, wherein said base is perforated.

28. The system of claim 27 further comprising a drain receiving water from said condensing surfaces.

29. A shower system for showering of a user comprising:

a primary wall comprising a sidewall comprising an interior surface and an exterior surface, a ceiling and a base, said interior surface of said primary wall defining a shower area, said interior surface comprising a hydrophobic surface, said exterior surface comprising a first condensing surface;

a secondary wall comprising an inner surface, said inner surface of said secondary wall comprising a second condensing surface, wherein an air channel is defined between said exterior surface of said primary wall and said inner surface of said secondary wall such that water within mist flowing through said air channel condenses on said first condensing surface and said second condensing surface;

a first row of misting nozzles coupled to said primary wall such that said first row of misting nozzles direct mist into said shower area at multiple angles with respect to a central area of said shower area, wherein said central area is substantially trans-axial to said shower stall;

a second row of misting nozzles coupled to said primary wall below said first row of misting nozzles such that said second row of misting nozzles direct mist into said shower area;

a fan coupled to at least a portion of at least one of said ceiling or said base;

at least one height sensor generating a height of user signal, and a controller comprising logic for receiving said height of user signal based on a height of the user, activating said first row of misting nozzles and said second row of misting nozzles as a function of said height signal, activating a misting cycle wherein a mist is directed out of said first row of misting nozzles and said second row of misting nozzles, activating a soaping cycle, activating a drying cycle, activating a cleaning cycle in response to the user leaving said shower area, and blowing air into said shower area, thereby forcing misted air out of said shower area and into said air channel.

30. The system of claim 29 further comprising a user accessible water input tank receiving water from the user prior to the user taking a shower.

31. A shower system for a vehicle comprising:

a changing area;

a shower stall adjacent to said changing area such that a user enters said shower stall directly from said changing area, said shower stall comprising, a primary wall comprising a sidewall comprising an interior surface and an exterior surface, a ceiling and a base, said interior surface of said primary wall defining a shower area, said interior surface comprising a hydrophobic surface, a secondary wall comprising an inner surface, wherein an air channel is defined between said exterior surface of said primary wall and said inner surface of said secondary wall such that water within mist flowing through said air channel condenses within said air channel;

a first row of misting nozzles coupled to said primary wall such that said first row of misting nozzles direct mist into said shower area at multiple angles with respect to a central area of said shower area;

a fan coupled to said shower stall;

at least one height sensor generating a height of user signal, and a controller activating said first row of misting nozzles when a user is within a first height range, said controller further controlling said fan, thereby blowing misted air out of said shower area and through said base whereby said misted air flows though said air channel, wherein said controller receiving said height of user signal so that water is delivered to said first row of missing nozzles depending on the height of the user.

32. The system of claim 31 further comprising a second row of misting nozzles coupled to said primary wall below said first row of misting nozzles such that said second row of misting nozzles direct mist into said shower area.

33. The system of claim 32, wherein said controller activates said second row of misting nozzles when a user is within a second height range.

34. The system of claim 32, wherein at least one of said inner surface of said secondary wall, said exterior surface of said primary wall, or an exterior surface of said base comprise a condensing surface.

35. The system of claim 32 further comprising a user accessible water input tank receiving water from a user prior to said user taking a shower.

36. The system of claim 32, wherein the controller further comprises logic for activating a misting cycle wherein a mist is directed out of said first row of misting nozzles, activating a soaping cycle, activating a drying cycle, and activating a cleaning cycle in response to the user leaving said shower area.

37. The system of claim 32 wherein said controller activates a third row of misting nozzles and a fourth row of misting nozzles when a user is within a third height range and a fourth height range respectively.

38. The system of claim 31, wherein said controller further comprises logic for activating a misting cycle wherein a mist is directed out of said at least one misting nozzle for a passenger selectable time period within a first predetermined time period, activating a soaping cycle for a passenger selectable time period within a second predetermined time period, activating a rising cycle for a passenger selectable time period within a third predetermined time period, activating a drying cycle for a passenger selectable time period within a fourth predetermined time period, and activating a cleaning cycle in response to the user leaving said shower area for a fifth predetermined time period.

39. The system of claim 38, wherein said first time period is less than 60 seconds, said second time period is less than 240 seconds, said third time period is less than 600 seconds, said fourth time period is less than 600 seconds, and said fifth time period is less than 90 seconds.

40. A shower system comprising:

a shower stall comprising a sidewall, a ceiling and a base, said shower stall defining a shower area, a shower stall housing enclosing said shower stall, wherein an air channel is defined between said shower stall and said shower stall housing, a plurality of misting nozzles positioned within said shower stall, at least one water pipe feeding said plurality of nozzles, a first number of said plurality of misting nozzles on a first row receiving water from said pipe, a second number of said plurality of misting nozzles mounted on a second row receiving water from said pipe, at least one height sensor generating a height of user signal, and a controller activating said first row of misting nozzles and said second row of misting nozzles when a user is within a first height range and activating only said second row of misting nozzles when said user is within a second height range, said controller further activating an air flow system such that misted air within said shower area flows through and is dried in said air channel, wherein said controller receiving said height of user signal so that water is delivered to said rows of misting nozzles depending on the height of the user.

41. A shower system comprising:

a shower stall comprising a sidewall, a ceiling and a base, said shower stall defining a shower area, a shower stall housing enclosing said shower stall defining a shower area, a plurality of misting nozzles positioned within said shower stall, at least one water pipe feeding said plurality of misting nozzles, positioned within said shower stall, wherein a first number of said plurality of misting nozzles mounted on a first row receives water from said pipe and a second number of said plurality of misting nozzles mounted on a second row receives water from said pipe, at least one height sensor generating a height of user signal, and a controller activating said first row of misting nozzles and said second row of misting nozzles when a user is within a first height range and activating only said second row of misting nozzles when said user is within a second height range, wherein said controller receiving said height of user signal so that water is delivered to said rows of misting nozzles depending on the height of the user.

* * * * *